US011014360B2

(12) United States Patent
Miura et al.

(10) Patent No.: US 11,014,360 B2
(45) Date of Patent: May 25, 2021

(54) LIQUID DISCHARGE APPARATUS, LIQUID DISCHARGE METHOD, AND RECORDING MEDIUM

(71) Applicants: Shogo Miura, Kanagawa (JP); Hiroki Takahashi, Kanagawa (JP); Hiroyuki Iwasaki, Kanagawa (JP)

(72) Inventors: Shogo Miura, Kanagawa (JP); Hiroki Takahashi, Kanagawa (JP); Hiroyuki Iwasaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/522,844

(22) Filed: Jul. 26, 2019

(65) Prior Publication Data

US 2020/0039225 A1 Feb. 6, 2020

(30) Foreign Application Priority Data

Jul. 31, 2018 (JP) ..... JP2018-144471
Jun. 20, 2019 (JP) ..... JP2019-114950

(51) Int. Cl.

| | |
|---|---|
| ***B41J 2/15*** | (2006.01) |
| ***B41J 2/21*** | (2006.01) |
| ***B41J 2/045*** | (2006.01) |
| *B41J 2/155* | (2006.01) |

(52) U.S. Cl.

CPC ..... *B41J 2/15* (2013.01); *B41J 2/04573* (2013.01); *B41J 2/21* (2013.01); *B41J 2/2132* (2013.01); *B41J 2/155* (2013.01)

(58) Field of Classification Search

CPC ..... B41J 2/15; B41J 2/04573; B41J 2/2132; B41J 2/21; B41J 2/155

See application file for complete search history.

(56) References Cited

U.S. PATENT DOCUMENTS 10,150,286 B2 * 12/2018 Tashiro ..... B41J 2/145

FOREIGN PATENT DOCUMENTS

| | | |
|---|---|---|
| JP | 2007-106086 | 4/2007 |
| JP | 2016-159530 | 9/2016 |
| JP | 2017-217810 | 12/2017 |

* cited by examiner

*Primary Examiner* — Geoffrey S Mruk
(74) *Attorney, Agent, or Firm* — IPUSA, PLLC

(57) ABSTRACT

A liquid discharge apparatus includes a first nozzle row group including at least two nozzle rows to discharge a first color liquid, shifted in the sub-scanning direction; a second nozzle row group including at least two nozzle rows to discharge a second color liquid, arranged in the main scanning direction; a main scanning device; a sub-scanning device; and circuitry to cause the first nozzle row group to discharge the first color liquid to positions corresponding to a plurality of pixels to form a first area on the recording medium, in accordance with scanning in the main scanning direction and the sub-scanning direction in a first sequence; and cause the second nozzle row group to discharge the second color liquid to positions corresponding to a plurality of pixels to form a second area on the recording medium, in accordance with scanning in the main scanning direction and the sub-scanning direction in a second sequence.

8 Claims, 13 Drawing Sheets

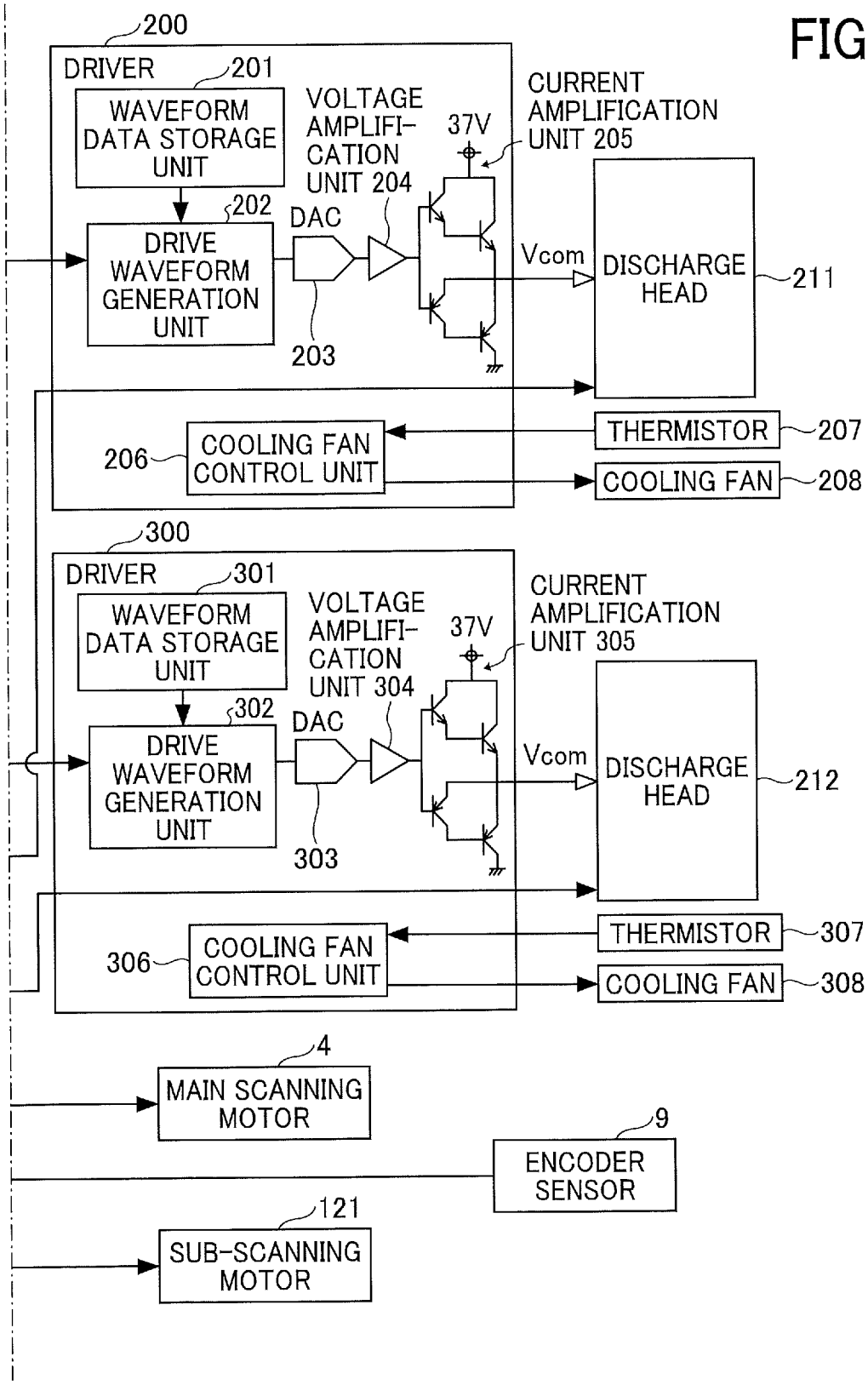
FIG. 5B
200
DRIVER
201
WAVEFORM DATA STORAGE UNIT
202
DRIVE WAVEFORM GENERATION UNIT
VOLTAGE AMPLIFI-CATION UNIT 204
DAC
203
37V
CURRENT AMPLIFICATION UNIT 205
Vcom
DISCHARGE HEAD
211
206
COOLING FAN CONTROL UNIT
THERMISTOR
207
COOLING FAN
208
300
DRIVER
301
WAVEFORM DATA STORAGE UNIT
302
DRIVE WAVEFORM GENERATION UNIT
VOLTAGE AMPLIFI-CATION UNIT 304
DAC
303
37V
CURRENT AMPLIFICATION UNIT 305
Vcom
DISCHARGE HEAD
212
306
COOLING FAN CONTROL UNIT
THERMISTOR
307
COOLING FAN
308
4
MAIN SCANNING MOTOR
9
ENCODER SENSOR
121
SUB-SCANNING MOTOR

LIQUID DISCHARGE APPARATUS, LIQUID DISCHARGE METHOD, AND RECORDING MEDIUM

CROSS-REFERENCE TO RELATED APPLICATIONS

This patent application is based on and claims priority pursuant to 35 U.S.C. § 119(a) to Japanese Patent Application Nos. 2018-144471, filed on Jul. 31, 2018, and 2019-114950, filed on Jun. 20, 2019, in the Japan Patent Office, the entire disclosure of each of which is hereby incorporated by reference herein.

BACKGROUND

Technical Field

The present disclosure relates to a liquid discharge apparatus, a liquid discharge method, and a recording medium.

Description of the Related Art

A liquid discharge apparatus such as a liquid discharge printer includes a discharge head having a nozzle row in which a plurality of nozzle holes for discharging a liquid such as ink is arranged and discharges ink from the nozzles to a recording medium for each pixel.

For such a liquid discharge apparatus, there is a multi-scan method in which the nozzle row scans a predetermined area of the recording medium plural times, and the ink is applied to the recording medium based on a decomposed image data decomposed (rendered) according to a divided image formed for each scan, thereby completing image formation in the predetermined area.

Meanwhile, in the field of signage and graphics for, for example, indoors or outdoors advertisements, there are liquid discharge apparatuses that discharge, in addition to process color inks such as black and yellow, inks of auxiliary colors (special colors), such as white and orange, different from the process colors. The "process colors" used here are primary colors used for producing processed colors.

SUMMARY

An embodiment of this disclosure provides a liquid discharge apparatus configured to discharge liquid onto a recording medium. The liquid discharge apparatus includes a plurality of nozzle rows in each of which a plurality of nozzle holes to discharge liquid is lined in a sub-scanning direction intersecting a main scanning direction. The plurality of nozzle rows includes a first nozzle row group including at least two nozzle rows disposed at positions shifted from each other in the sub-scanning direction and configured to discharge a first color liquid; and a second nozzle row group including at least two nozzle rows arranged in the main scanning direction and configured to discharge a second color liquid different in color from the first color liquid. The liquid discharge apparatus further includes a main scanning device configured to cause the first nozzle row group and the second nozzle row group to scan the recording medium a plurality of times in the main scanning direction; a sub-scanning device configured to cause the first nozzle row group and the second nozzle row group to scan the recording medium a plurality of times in the sub-scanning direction; and circuitry. The circuitry is configured to cause the first nozzle row group to discharge the first color liquid to positions corresponding to a plurality of pixels to form a first area on the recording medium, in accordance with scanning in the main scanning direction and the sub-scanning direction in a first sequence; and cause the second nozzle row group to discharge the second color liquid to positions corresponding to a plurality of pixels to form a second area on the recording medium, in accordance with scanning in the main scanning direction and the sub-scanning direction in a second sequence different from the first sequence.

Another embodiment provides a liquid discharge method for discharging a liquid by the liquid discharge apparatus described above. The method includes causing the first nozzle row group and the second nozzle row group to scan a recording medium in the main scanning direction a plurality of times; causing the first nozzle row group and the second nozzle row group to scan the recording medium in the sub-scanning direction a plurality of times; discharging, with the first nozzle row group, the first color liquid corresponding to a plurality of pixels to form a first area on the recording medium, in accordance with scanning in the main scanning direction and the sub-scanning direction in a first sequence; and discharging, with the second nozzle row group, the second color liquid corresponding to a plurality of pixels to form a second area on the recording medium, in accordance with scanning in the main scanning direction and the sub-scanning direction in a second sequence different from the first sequence.

Yet another embodiment provides a non-transitory recording medium storing a plurality of program codes which, when executed by one or more processors, causes the processors to perform the method described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIGS. 5A and 5B (FIG. 5) are block diagrams illustrating functional units of a controller according to Embodiment 1;

Figure 1:
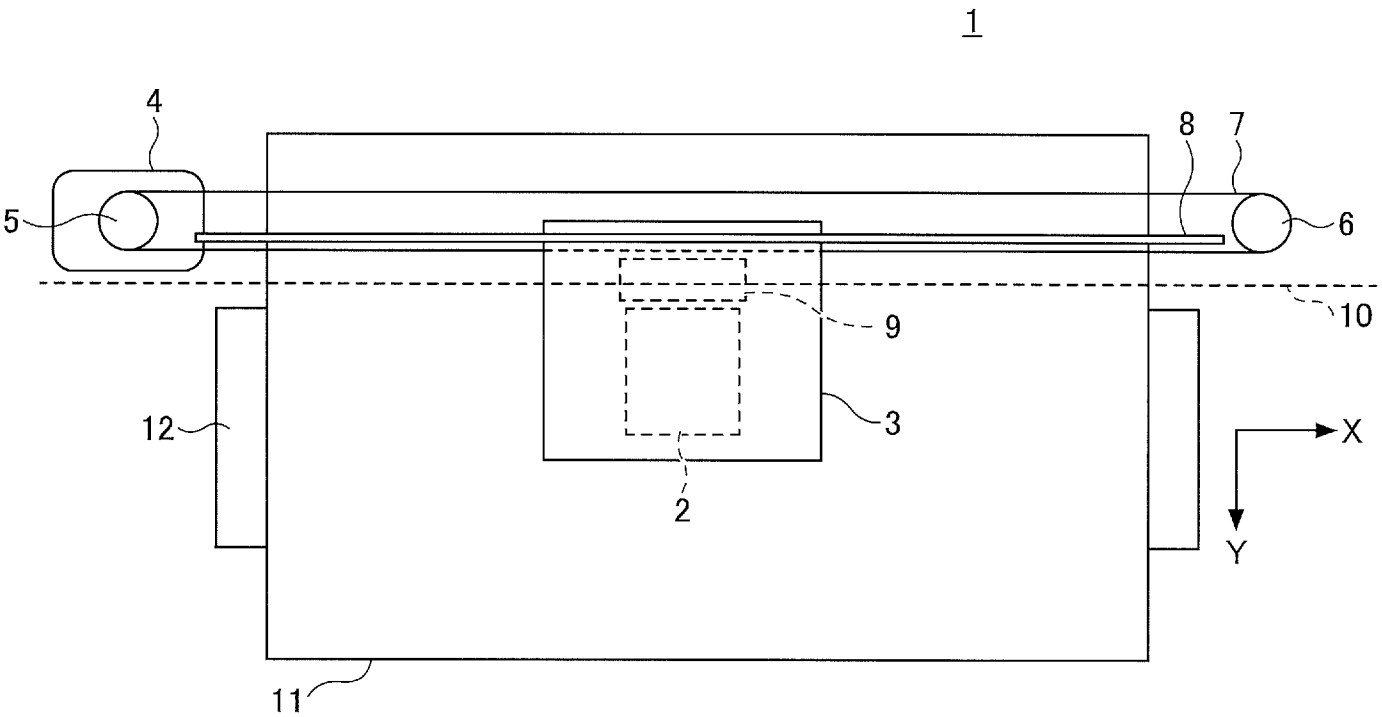
FIG. 1 is a schematic view of an example configuration of an image forming apparatus according to Embodiment 1.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, an image forming apparatus according to an embodiment of this disclosure is described. As used herein, the singular forms "a", "an", and "the" are intended to include the plural forms as well, unless the context clearly indicates otherwise.

The suffixes y, m, c, and k attached to each reference numeral indicate only that components indicated thereby are used for forming yellow, magenta, cyan, and black images, respectively, and hereinafter may be omitted when color discrimination is not necessary.

Descriptions below concerns embodiments in which aspects of the present disclosure are applied to an inkjet image forming apparatus to apply ink to a sheet. The image forming apparatus is an example of a "liquid discharge apparatus", the sheet is an example of a "recording medium", and the ink is an example of "liquid".

In each drawing, arrow X indicates a main scanning direction (i.e., X-axis direction in the drawings), and arrow Y indicates a sub-scanning direction (Y-axis direction in the drawings) intersecting the main scanning direction.

Embodiment 1

FIG. 1 is a schematic view of an example configuration of the image forming apparatus according to the present embodiment.

As illustrated in FIG. 1, an image forming apparatus 1 includes a head unit 2, a carriage 3, a main scanning motor 4, a gear 5, a pressure roller 6, a timing belt 7, a guide rod 8, an encoder sensor 9, an encoder sheet 10, and a platen 12. The image forming apparatus 1 employs a multi-scan method and the head unit 2 performs scanning a plurality of times, moved by the carriage 3.

The head unit 2 includes a plurality of discharge heads (discharge heads 211, 212, and 213 illustrated in FIG. 4) and is secured to the carriage 3. The plurality of discharge heads discharges process color inks and an auxiliary color ink. Note that the process colors are four basic colors for image formation. The process color inks include, for example, a black ink, a cyan ink, a magenta ink, and a yellow ink. Examples of the auxiliary color ink are, for example, an orange ink and a green ink. The process color is an example of a "first color", and the auxiliary color is an example of a "second color". The auxiliary color is an example of a "color other than yellow, magenta, cyan and black". The configuration of the discharge head will be described in detail with reference to FIG. 2, and the configuration of the head unit 2 will be described in detail with reference to FIG. 3.

The main scanning motor 4 transmits the driving force by the rotation to the carriage 3, via the gear 5, the pressure roller 6, and the timing belt 7. The carriage 3 reciprocates (reciprocation scanning) in the main scanning direction (X-axis direction) along the guide rod 8. The head unit 2 can move in the main scanning direction as the carriage 3 reciprocates in the main scanning direction.

The encoder sheet 10 has a linear scale that indicates the position in the main scanning direction. As the carriage 3 moves in the main scanning direction, the encoder sensor 9 provided in the carriage 3 reads the linear scale of the encoder sheet 10 and detects the position in the main scanning direction.

Meanwhile, by the drive force caused by rotation of a sub-scanning motor 121 (illustrated in FIG. 5B), a sheet 11 is conveyed in the sub-scanning direction (Y-axis direction) from a sheet supply unit of the image forming apparatus 1 along a predetermined conveyance passage to the position of the platen 12. The sub-scanning motor 121 and the like that cause the head unit 2 to relatively scan the sheet 11 in the sub-scanning direction together serve as a sub-scanning device.

While being moved in the main scanning direction, the discharge head of the head unit 2 discharges the ink toward the sheet 11 and applies the ink onto the sheet 11. When one scan of the head unit 2 in the main scanning direction is completed, the sheet 11 is conveyed by a predetermined amount in the sub-scanning direction. When the conveyance of the sheet 11 in the sub-scanning direction is completed, the discharge head of the head unit 2 again discharges the ink and applies the ink onto the sheet 11 while being moved in the main scanning direction.

While such scanning of the head unit 2 in the main scanning direction, conveyance of the sheet 11 in the sub-scanning direction, and the discharge of the ink by the discharge head in accordance with the scanning and the conveyance are repeated, for example, a color image is formed on the sheet 11.

The discharge head of the head unit 2 can discharge the ink toward the sheet 11 while being moved to, at least, one of the positive side and the negative side in the main scanning direction (positive main scanning direction and negative main scanning direction).

Figure 2:
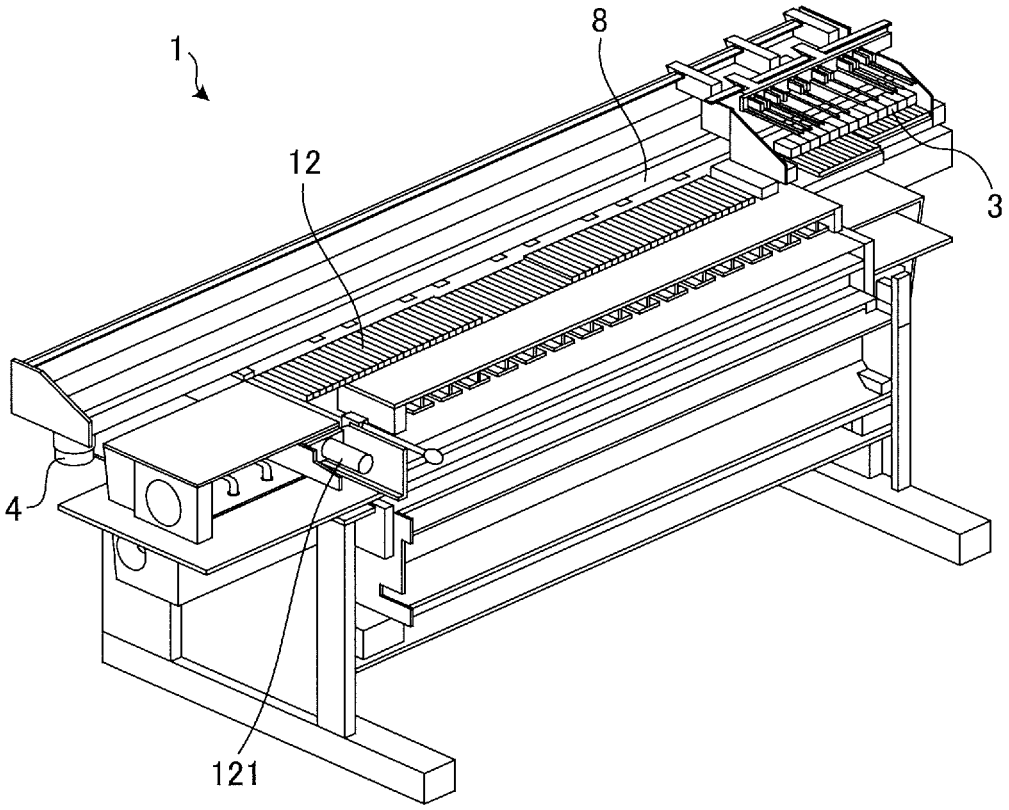
FIG. 2 is an exterior view of the image forming apparatus according to Embodiment 1.

FIG. 2 is a schematic exterior view of the image forming apparatus according to the present embodiment. In FIG. 2, the carriage 3, the main scanning motor 4, the guide rod 8, the platen 12, and the sub-scanning motor 121 provided in the image forming apparatus 1 are illustrated.

Figure 3:
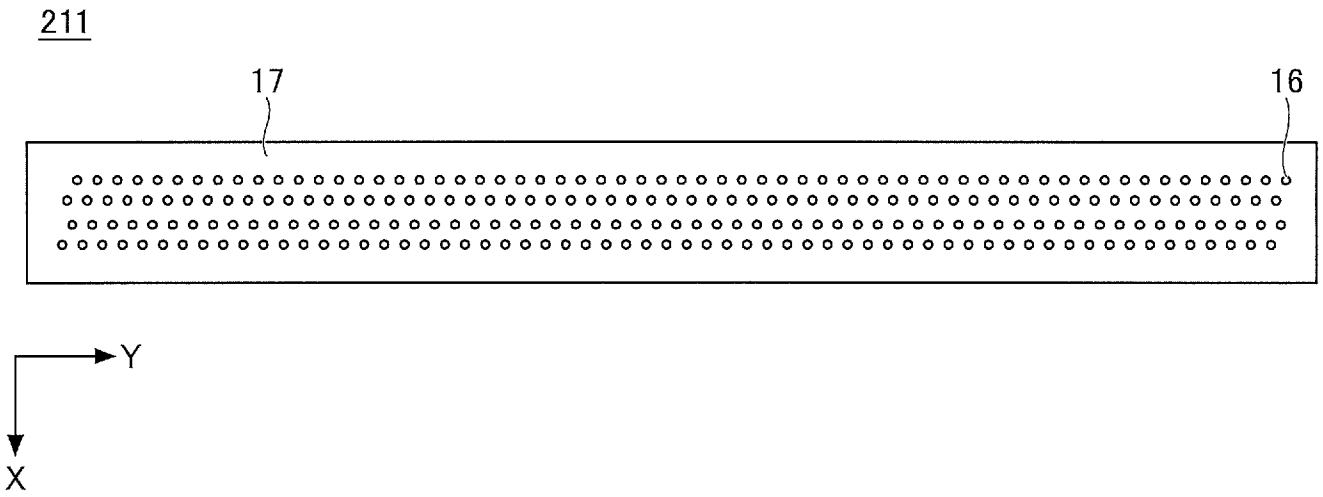
FIG. 3 is a plan view illustrating an example of a configuration of a discharge head according to Embodiment 1.

FIG. 3 is a view illustrating an example of the configuration of the discharge head according to the present embodiment. FIG. 3 is a plan view of the discharge head as viewed in the direction in which the ink is discharged.

The discharge head 211 includes a nozzle plate 17. In the nozzle plate 17, a plurality of nozzle holes 16 are arranged at equal intervals in the sub-scanning direction. In the example of FIG. 3, 64 nozzle holes 16 are lined in the sub-scanning direction into a nozzle row, and 4 nozzle rows are arrayed in the main scanning direction.

Each nozzle row is shifted from the adjacent nozzle row in the sub-scanning direction by half the distance between the nozzle holes 16. In other words, the nozzle rows are staggered. By arranging the nozzle rows in a staggered manner, the density (resolution) of image formation in the sub-scanning direction can be improved.

The discharge head 211 discharges ink from each nozzle hole. Further, the discharge head 211 discharges ink of a different color for each nozzle row.

Figure 4:
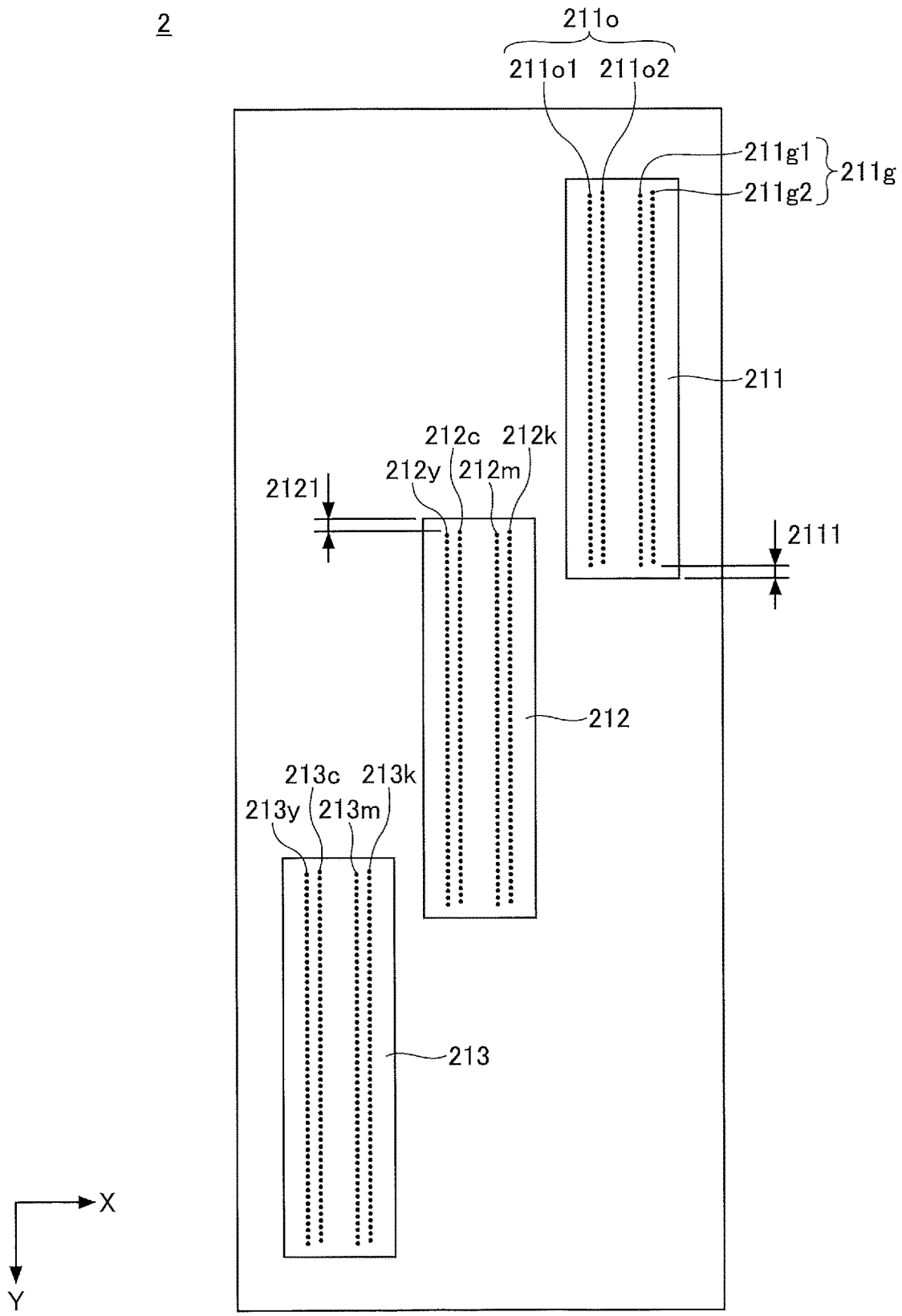
FIG. 4 is a view illustrating an example of a configuration of a head unit according to Embodiment 1.

FIG. 4 is a view illustrating an example of the configuration of the head unit 2 according to the present embodiment. FIG. 4 is a plan view of the head unit 2 as viewed in the ink discharge direction.

The head unit 2 includes the discharge heads 211, 212, and 213. The discharge heads 212 and 213 have the same configuration as the discharge head 211 described with reference to FIG. 3.

In the head unit 2, the discharge head 211 is disposed extreme downstream in the positive main scanning direction among the three discharge heads 211 to 213. Further, the discharge head 211 is extreme upstream in the sub-scanning direction (the first from the negative side in the sub-scanning direction) among the three discharge heads 211 to 213. The discharge head 211 includes a nozzle row group 211*o* and a nozzle row group 211*g*. The nozzle row group 211*o* includes a nozzle row 211*o*1 and a nozzle row 211*o*2, and the nozzle row group 211*g* includes a nozzle row 211*g*1 and a nozzle row 211*g*2.

The nozzle row 211*o*1 discharges orange ink, which is one of the auxiliary colors, from 64 nozzle holes lined in the sub-scanning direction. The nozzle row 211*o*2 is disposed at a position apart from the nozzle row 211*o*1 in the positive main scanning direction. The nozzle row 211*o*2 discharges orange ink from 64 nozzle holes lined in the sub-scanning direction.

The nozzle row 211*g*1 is disposed at a position apart from the nozzle row 211*o*2 in the positive main scanning direction. The nozzle row 211*o*1 discharges green ink, which is one of the auxiliary colors, from 64 nozzle holes lined in the sub-scanning direction. The nozzle row 211*g*2 is disposed at a position apart from the nozzle row 211*g*1 in the positive main scanning direction and discharges green ink from 64 nozzle holes lined in the sub-scanning direction.

In the head unit 2, the discharge head 212 is disposed at a position deviated from the discharge head 211 to the negative side in the main scanning direction (in the negative main scanning direction) and to the positive side in the sub-scanning direction (in the positive sub-scanning direction). The discharge head 212 includes a nozzle row 212*y*, a nozzle row 212*c*, a nozzle row 212*m*, and a nozzle row 212*k*.

The nozzle row 212*y* discharges yellow ink, which is one of the process colors, from 64 nozzle holes lined in the sub-scanning direction. The nozzle row 212*c* is disposed at a position apart from the nozzle row 212*y* in the positive main scanning direction. The nozzle row 212*c* discharges cyan ink, which is one of the process colors, from the nozzle holes lined in the sub-scanning direction.

The nozzle row 212*m* is disposed at a position apart from the nozzle row 212*c* in the positive main scanning direction. The nozzle row 212*m* discharges magenta ink, which is one of the process colors, from the 64 nozzle holes lined in the sub-scanning direction. The nozzle row 212*k* is disposed at a position apart from the nozzle row 212*m* in the positive main scanning direction. The nozzle row 212*k* discharges black ink, which is one of the process colors, from the nozzle holes lined in the sub-scanning direction.

In the head unit 2, the discharge head 213 is disposed extreme upstream (the first from the negative side) in the positive main scanning direction among the three discharge heads 211 to 213. Further, the discharge head 213 is extreme downstream in the sub-scanning direction (the first from the positive side in the sub-scanning direction) among the three discharge heads 211 to 213. The discharge head 213 includes a nozzle row 213*y*, a nozzle row 213*c*, a nozzle row 213*m*, and a nozzle row 213*k*. The configuration and function of each nozzle row are the same as those of the discharge head 212, and thus the description thereof is omitted.

The nozzle row groups 211*o* and 211*g* of the discharge head 211 are examples of the "second nozzle row group". Further, a nozzle row group including the nozzle row 212*y* of the discharge head 212 and the nozzle row 213*y* of the discharge head 213 is an example of "first nozzle row group". Similarly, a nozzle row group including the nozzle row 212*c* and the nozzle row 213*c*, a nozzle row group including the nozzle row 212*m* and the nozzle row 213*m*, and a nozzle row group including the nozzle row 212*k* and the nozzle row 213*k* are examples of the "first nozzle row group".

As illustrated in FIG. 4, the discharge head 212 is disposed at a position shifted from the discharge head 211 in the sub-scanning direction, and the discharge head 213 is disposed at a position shifted from the discharge head 212 in the sub-scanning direction. Such an arrangement can expand the range in which the ink is applied to the sheet 11 in the sub-scanning direction in one scan in the main scanning direction of the head unit 2.

Here, at both ends of each of the discharge heads 211 to 213 in the sub-scanning direction, there are regions where no nozzle holes are formed (no-nozzle regions). For example, as illustrated in FIG. 4, the no-nozzle region at one end of the discharge head 211 has a length 2111 in the sub-scanning direction, and the no-nozzle region at one end of the discharge head 212 has a length 2121 in the sub-scanning direction. The discharge head 212 is disposed so as to overlap the discharge head 211 in the sub-scanning direction with a length equal to or greater than the sum of the length 2111 and the length 2121. In addition, the discharge head 212 is shifted from the discharge head 211 in the negative main scanning direction. In such an arrangement, even when the discharge heads 211 to 213 are shifted from each other in the sub-scanning direction as described above, an area where ink is not applied to the sheet 11 in the sub-scanning direction is not caused by the no-nozzle region. Such an arrangement and the effect thereof are the same as those by the arrangement of the discharge head 213 relative to the discharge head 212.

Figure 5A:
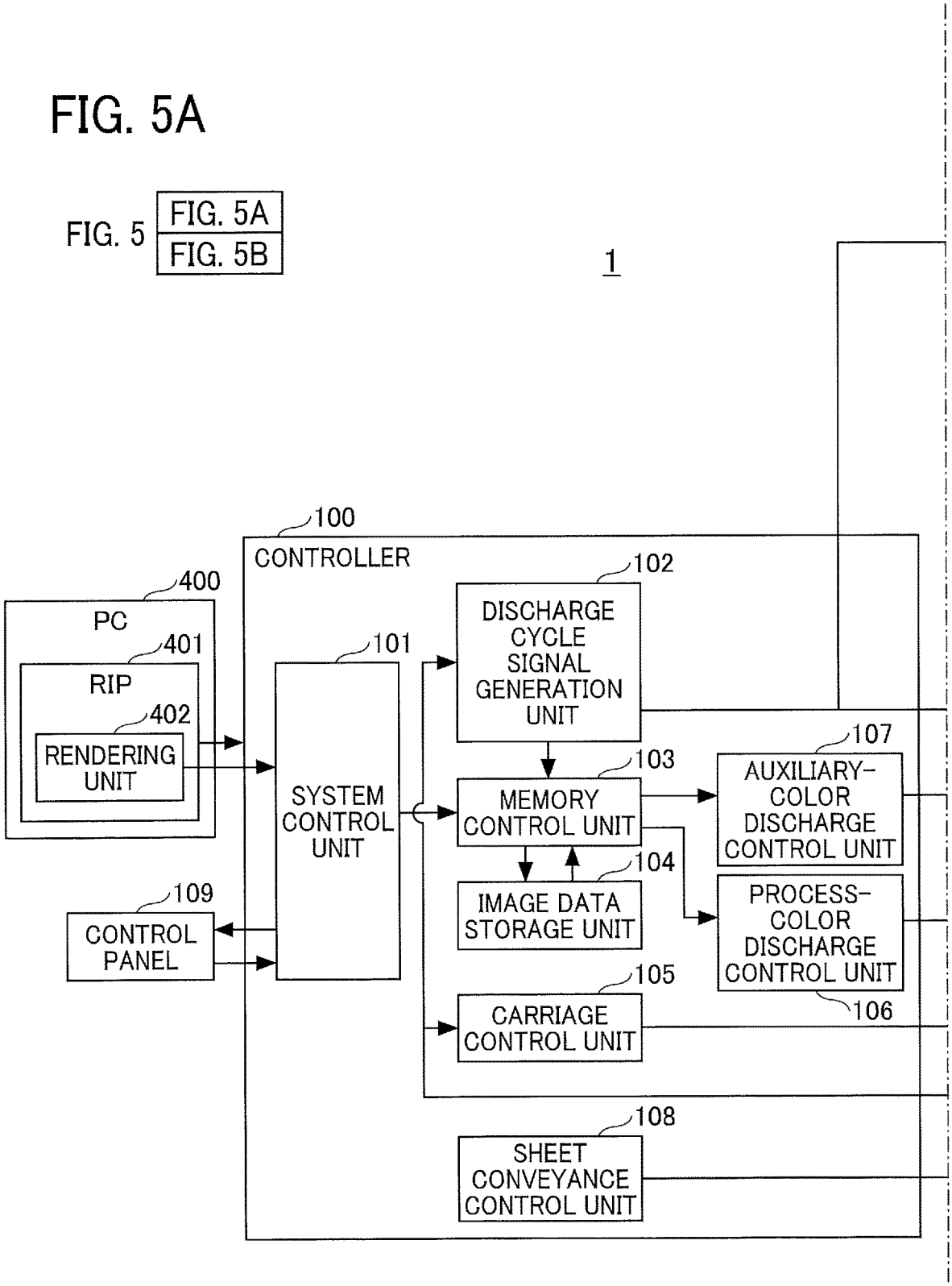

Next, descriptions are given below of components and functional blocks of a controller 100 of the image forming apparatus 1 according to the present embodiment, with reference to FIGS. 5A and 5B (FIG. 5). Note that each functional block of the controller 100 illustrated in FIG. 5 is conceptual, and the controller 100 is not necessarily configured physically as illustrated in FIG. 5. The whole or a portion of each functional block can be functionally or physically divided into given units or combined with whole or a portion of another functional block. The whole or a portion of each processing function performed in each functional block can be implemented by a program executed by a central processing unit (CPU) of the controller 100 or implemented as hardware by a wired logic.

For example, the controller 100 includes the CPU, a read only memory (ROM), a random access memory (RAM) and the like. As the CPU executes a program stored in the ROM in cooperation with the RAM, the function of each block is implemented. Alternatively, an electronic circuit such as an application specific integrated circuit (ASIC) or a field-programmable gate array (FPGA) can execute the processing executed by the CPU.

The controller 100 includes a system control unit 101, a discharge cycle signal generation unit 102, a memory control unit 103, an image data storage unit 104, a carriage control unit 105, a process-color discharge control unit 106, an auxiliary-color discharge control unit 107, and a sheet conveyance control unit 108.

The controller 100 are electrically connected to a driver 200 to drive the discharge head 211, a driver 300 to drive the discharge head 212, a personal computer (PC) 400, a control panel 109, the main scanning motor 4, the sub-scanning motor 121, and the encoder sensor 9.

The PC 400 performs input of image data for forming an image on the sheet 11, setting of the resolution of image formation by the image forming apparatus 1, and the like. The PC 400 transmits the image data and an instruction for controlling the image forming apparatus 1 to the controller 100. The PC 400 includes a raster image processor (RIP) unit 401 and a rendering unit 402. The RIP unit 401 executes image processing in accordance with a color profile and user setting.

Here, in the multi-scan method, in each scan, the head unit 2 discharges an ink droplet corresponding to a predetermined pixel, of a plurality of pixels to form a predetermined area of the sheet 11. The pixels to which the ink is to be applied in each scan of the head unit 2 are identified based on the rendering data.

The rendering unit 402 decomposes the image data into rendering data for each scan of the head unit 2. At this time, the rendering unit 402 sets pixels to which ink is to be deposited as valid data, sets pixels to which ink is not deposited as invalid data, and then generates thinning data including valid data and invalid data.

The thinning data is, for example, binary image data in which valid data is "1" and invalid data is "0". By integrating the thinning data and the image data, the pixel to which the ink is to be applied in each scan can be identified.

The rendering unit 402 generates, as thinning data, process color thinning data and auxiliary color thinning data, which are output to the system control unit 101.

The system control unit 101 receives image data and an instruction sent from the PC 400. Further, an operation signal is input from the user via the control panel 109 of the image forming apparatus 1. The system control unit 101 controls the operation of the image forming apparatus 1 according to such an input.

The image data storage unit 104 is a memory to temporarily store the image data received by the system control unit 101. The memory control unit 103 controls at least one of input and output of image data to the image data storage unit 104.

The discharge cycle signal generation unit 102 a signal indicating the timing at which the discharge heads 211 to 213 discharge ink in synchronization with the movement of the carriage 3, based on the output signal of the encoder sensor 9 and the resolution of image formation set by the user.

The process-color discharge control unit 106 receives, via the system control unit 101 and the memory control unit 103, the process color thinning data generated by the rendering unit 402. Based on the process color thinning data, the process-color discharge control unit 106 causes the discharge heads 212 and 213 to discharge the process color inks in the pixels corresponding to the effective data of the image data input from the memory control unit 103.

The auxiliary-color discharge control unit 107 receives, via the system control unit 101 and the memory control unit 103, the auxiliary color thinning data generated by the rendering unit 402. Based on the auxiliary color thinning data, the auxiliary-color discharge control unit 107 causes the discharge head 211 to discharge the auxiliary color ink in the pixels corresponding to the effective data of the image data input from the memory control unit 103.

The operations of the process-color discharge control unit 106 and the auxiliary-color discharge control unit 107 will be described in detail later, with reference to FIGS. 7 to 8.

The process-color discharge control unit 106 is an example of "first discharge control unit", and the auxiliary-color discharge control unit 107 is an example of "second discharge control unit".

The process-color discharge control unit 106 and the auxiliary-color discharge control unit 107 can be configured to control the ink discharge for each nozzle row.

The carriage control unit 105 drives the main scanning motor 4 based on the output signal of the encoder sensor 9, to control the position of the carriage 3 in the main scanning direction. The carriage control unit 105 is an example of "main scanning unit".

The sheet conveyance control unit 108 drives the sub-scanning motor 121 according to an instruction from the system control unit 101, to convey the sheet 11 in the sub-scanning direction, and controls the position of the sheet 11 in the sub-scanning direction. The sheet conveyance control unit 108 can cause the carriage 3 to relatively scan the sheet 11 in the sub-scanning direction by conveying the sheet 11 in the sub-scanning direction. The sheet conveyance control unit 108 is an example of "sub-scanning unit".

The driver 200 includes a waveform data storage unit 201, a drive waveform generation unit 202, a digital to analog converter (DAC) 203, a voltage amplification unit 204, a current amplification unit 205, and a cooling fan control unit 206. The driver 200 drives the discharge head 211 to discharge the auxiliary color ink. For example, the discharge head 211 includes a piezoelectric member that expands and contracts by an applied voltage, and the driver 200 drives the piezoelectric member to discharge the auxiliary color ink.

The waveform data storage unit 201 stores the waveform of a voltage signal to drive the discharge head 211 as drive waveform data.

The drive waveform generation unit 202 generates a drive waveform according to the droplet size of the ink to be discharged, based on the drive waveform data. For example, in the case where the drive waveform data includes three pulse waveforms corresponding to a small droplet, the drive waveform generation unit 202 generates a drive waveform in which two of the three pulse waveforms are invalidated for discharge of the small droplet. Further, the drive waveform generation unit 202 generates a drive waveform in which one of the three pulse waveforms is invalidated for discharge of a medium droplet discharge, and generates a drive waveform in which all the three pulse waveforms are valid for discharge of a large droplet.

The DAC 203 converts the drive waveform in the form of digital voltage to a drive waveform in the form of analog voltage (i.e., an analog drive waveform). The voltage amplification unit 204 amplifies the converted analog drive waveform, and the current amplification unit 205 amplifies the current of the converted analog drive waveform. Then, the converted analog drive waveform is input to the discharge head 211.

The cooling fan control unit 206 is electrically connected to the thermistor 207 included in the discharge head 211 and the cooling fan 208. The cooling fan control unit 206 drives the cooling fan 208 based on a signal or the like indicating the temperature detected by the thermistor 207, thereby controlling the temperature of the discharge head 211. Such a control operation can alleviate the viscosity change and the like accompanying the temperature rise of the auxiliary color ink stored in the discharge head 211.

The driver 300 includes a drive waveform data storage unit 301, a drive waveform generation unit 302, a DAC 303, a voltage amplification unit 304, a current amplification unit 305, and a cooling fan control unit 306, and drives the discharge head 212 to discharge the process color ink. For example, the discharge head 212 includes a piezoelectric member that expands and contracts by an applied voltage, and the driver 300 drives the piezoelectric member to discharge the process color ink.

The function of the drive waveform data storage unit 301 is similar to that of the waveform data storage unit 201, the function of the drive waveform generation unit 302 is similar to that of the drive waveform generation unit 202, and the function of the DAC 303 is similar to that of the DAC 203. The function of the voltage amplification unit 304 is similar to that of the voltage amplification unit 204, the function of the current amplification unit 305 is similar to that of the current amplification unit 205, and the function of the cooling fan control unit 306 is similar to that of the cooling fan control unit 206. Therefore, descriptions thereof are omitted.

The controller 100 is further connected to the driver of the discharge head 213 and controls the driver of the discharge head 213 in a manner similar to the control of the driver 300 of the discharge head 212, and thus the illustration and description thereof will be omitted.

Although FIG. 5 illustrates the configuration in which the rendering unit 402 is included in the PC 400, the controller 100 may have the function of the rendering unit 402. Similarly, the controller 100 may have the function of the RIP unit 401. The controller 100 may have some or all of the functions of the driver 200 and may have some or all of the functions of the driver 300.

Here, the multi-scan method will be described. An inkjet image forming apparatus discharges ink toward the sheet 11, and the ink landed on the sheet 11 adheres to the sheet 11 to form a pixel. When the resolution of image formation is high, the interval between adjacent pixels becomes short, and merging of adjacent ink droplets landed on the sheet 11 occurs. Note that, the term "merging" used here means that adjacent droplets of liquid such as ink are combined into one, and two pixels are undesirably combined, resulting in image noise.

To prevent such ink merging on the sheet 11, in the multi-scan method, the ink discharged is divided corresponding to a plurality of scans of the head unit 2, and the ink is applied onto the sheet 11 for each scan, thereby securing a time lag in ink landing of adjacent pixels.

For example, when an ink droplet to form one of adjacent pixels lands on the sheet 11 immediately after landing of an ink droplet to form the other of the adjacent pixels, both ink droplets stays undried. Then, it is possible that both droplets attracting each other spread and merge together. By contrast, when a time lag is given, the ink droplet of one pixel dries and solidifies before the ink droplet of the other pixel lands on the sheet 11. Therefore, at the landing of the ink droplet of the other pixel, the ink droplet is not attracted to the preceding ink droplet and does not spread. This prevents ink merging in adjacent pixels.

In the multi-scan method, the head unit 2 is caused to scan a predetermined area of the sheet 11 a plurality of times, and the ink is discharged based on the rendering data for each scan to complete the image formation of the predetermined area.

Figure 6A:
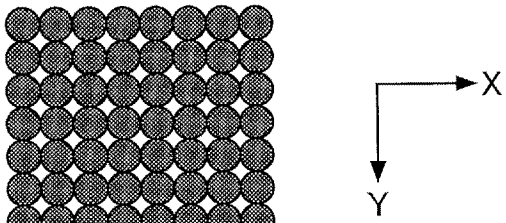
FIGS. 6A, 6B, and 6C are views illustrating an example of a multi-scan image formation.
Figure 6B:
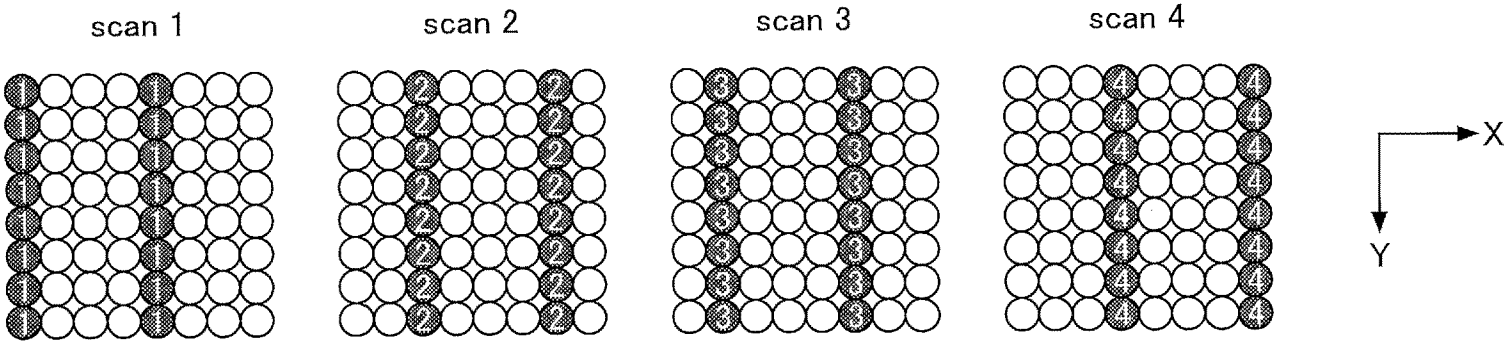
Figure 6C:
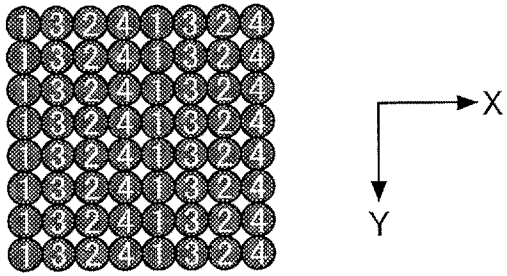

FIGS. 6A, 6B, and 6C are views illustrating an example of multi-scan image formation. FIG. 6A illustrates an example of image data as a source of image formation. A plurality of circles illustrated in FIG. 6A each represents a pixel and corresponds to one of a plurality of pixels that forms a given area of the sheet 11. In image formation, ink is applied to each of such pixels.

FIG. 6B illustrates rendering data for each scan. In FIG. 6B, reference "scan 1" is given to rendering data of an image formed in a first scan. White circles indicate pixels where ink is discharged, and the ink adheres to the sheet 11. Black circles indicate pixels where the ink is not discharged, and the ink does not adhere to the sheet 11. The number "1" in the white circles indicates that the ink is applied to the pixel indicated thereby in the first scan.

Reference "scan 2" is given to rendering data of an image formed in the second scan. Similarly, white circles indicate pixels where ink is discharged, and the ink adheres to the sheet 11. The number "2" in the white circles indicates that the ink is applied to the pixel indicated thereby in the second scan.

Reference "scan 3" is given to rendering data of an image formed in the third scan. The number "3" in the white circles indicates the ink is applied to the pixel indicated thereby in the third scan.

Reference "scan 4" is given to rendering data of an image formed in the fourth scan. The number "4" in the white circles indicates that the ink is applied to the pixel indicated thereby in the fourth scan.

FIG. 6C illustrates an image formed by application of ink on the given area of the sheet 11. As the ink is sequentially applied to the pixels in each scan as illustrated in FIG. 6B, an image is formed in the given area of the sheet 11 as illustrated in FIG. 6C.

Although FIG. 6 illustrates an example of rendering data in which ¾ of the image data are not printed in each scan so that the ink is applied to ¼ of the pixels in each scan, aspects of the present disclosure can adapt to other rendering methods. The rendering unit 402 can generate appropriate rendering data according to the image formation resolution and the image formation sequence.

Next, a comparative example of the multi-scan method will be described with reference to FIG. 7. In the comparative example illustrated in FIG. 7, the head unit 2 illustrated in FIG. 4 discharges, by the multi-scan method, one of the process color inks and one auxiliary color ink corresponding to a plurality of pixels to form a given area of the sheet 11, and the sequence of ink discharge is the same between the process color inks and the auxiliary color ink. For example, the process color ink is the yellow ink, and the auxiliary color ink is the orange ink.

The discharge head 211 illustrated in FIG. 7 discharges the auxiliary color ink in the same manner as described with reference to FIG. 4. For ease of understanding, FIG. 7 illustrates four nozzle holes of the nozzle row 211*o*1 and four nozzle holes of the nozzle row 211*o*2 in contrast to those illustrated in FIG. 4. Similarly, the discharge heads 212 and 213 discharge the process color inks in the same manner as described with reference to FIG. 4, and FIG. 7 illustrates four nozzle holes of the nozzle row 212*y* and four nozzle holes of the nozzle row 213*y* in contrast to those illustrated in FIG. 4.

Figure 7:
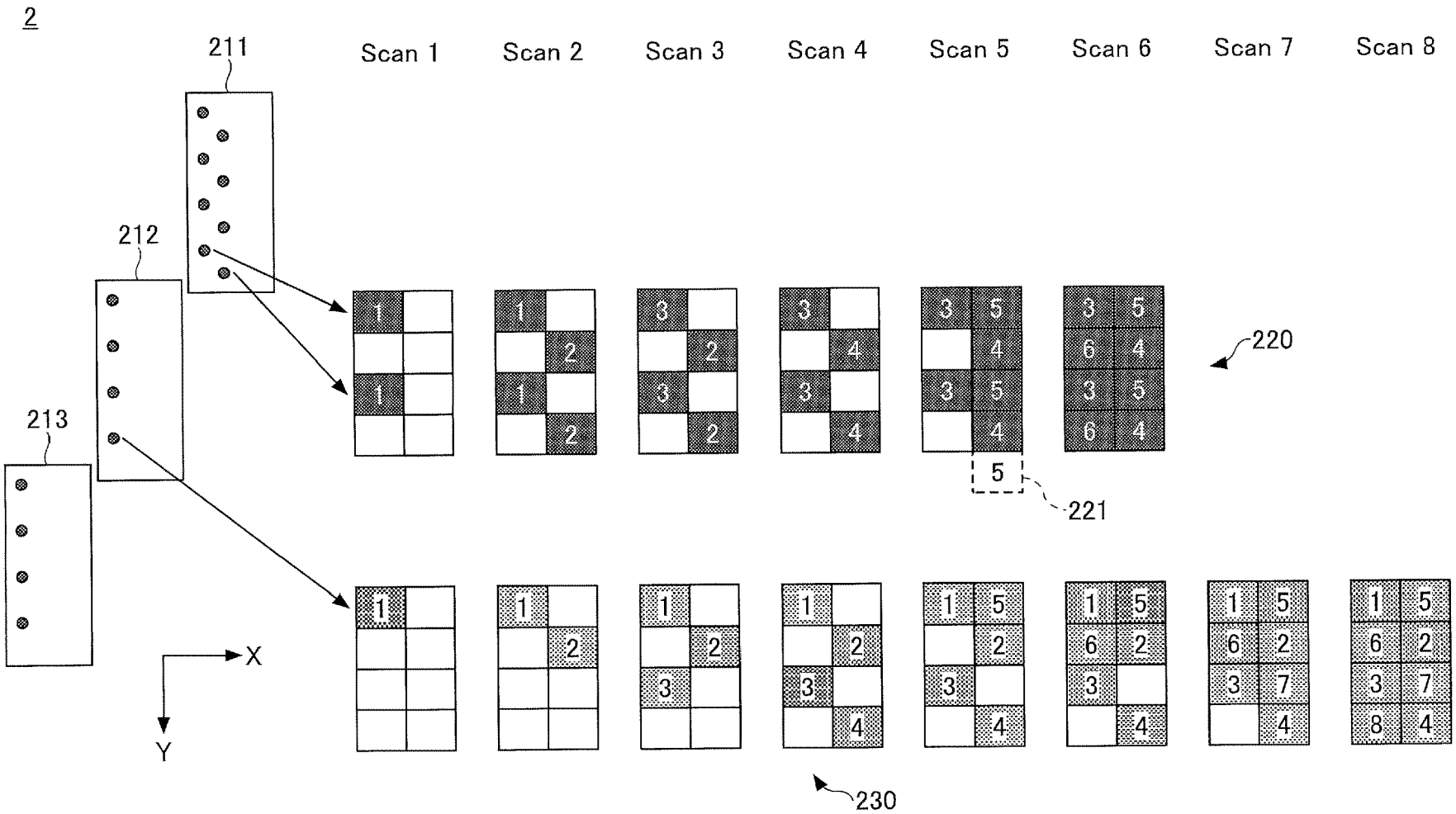
FIG. 7 is a diagram for explaining multi-scan image formation according to a comparative example.

FIG. 7 illustrates an example of discharging the auxiliary color ink from one nozzle hole of each of the nozzle row 211*o*1 and the nozzle row 211*o*2 of the discharge head 211. Further, in the illustrated example, the process color ink is discharged from one nozzle hole of the nozzle row 212*y* of the discharge head 212.

The squares illustrated on the right side of the discharge heads 211 to 213 indicate the pixels of the image formed on the sheet 11.

A pixel area 220 illustrated corresponding to the discharge head 211 is a pixel area to which the discharge head 211 applies the auxiliary color ink. The black squares are pixels to which the auxiliary color ink has been applied, and the numbers given in the squares indicate the ordinal number of the scan in which the auxiliary color ink has been applied. An image of eight pixels is formed with the auxiliary color ink discharged from the two nozzle holes of the discharge head 211.

A pixel area 230 illustrated corresponding to the discharge head 212 is a pixel area to which the discharge head 212 applies the process color ink. The gray squares are pixels to which the process color ink has been applied, and the numbers given in the squares indicate the ordinal number of the scan in which the process color ink has applied. An image of eight pixels is formed with process color ink discharged from one nozzle hole of the discharge head 212.

"Scan 1" to "Scan 8" at the top of the figure indicate the ordinal numbers of scans. For example, in FIG. 7, below the "Scan 1", pixels at which the auxiliary color ink is applied and pixels at which the process color ink is applied in the first scan in the main scanning direction are illustrated in association with "Scan 1". Similarly, below the "Scan 2" to "Scan 8", the pixel at which the auxiliary color ink is applied and the pixel at which the process color ink is applied in the respective scans in the main scanning direction are illustrated.

In the first scan (Scan 1), the discharge head 211 applies the auxiliary color ink to positions on the sheet 11 corresponding to two pixels, and the discharge head 212 applies the process color ink to a position corresponding to one pixel, as illustrated in FIG. 7.

In the second scan (Scan 2), the discharge head 211 applies the auxiliary color ink to positions shifted by one pixel in each of the positive main scanning direction and the positive sub-scanning direction from the positions to which the ink is applied in the first scan. Similarly, the discharge head 212 applies the process color ink to positions shifted by one pixel in each of the positive main scanning direction and the positive sub-scanning direction from the position to which the ink is applied in the first scan.

In the third scan (Scan 3), the discharge head 211 applies the auxiliary color ink to positions shifted by one pixel in each of the negative main scanning direction and the positive sub-scanning direction from the positions to which the ink is applied in the second scan. Although the ink has already been applied to those positions in the first scan, the ink in the third scan is superimposed thereon. Similarly, the discharge head 212 applies the process color ink to positions shifted by one pixel in each of the negative main scanning direction and the positive sub-scanning direction from the positions to which the ink is applied in the second scan.

In the fourth scan (Scan 4), the discharge head 211 applies the auxiliary color ink to positions shifted by one pixel in each of the positive main scanning direction and the positive sub-scanning direction from the positions to which the ink is applied in the third scan. Although the ink has already been applied to those positions in the second scan, the ink in the fourth scan is superimposed thereon. Similarly, the discharge head 212 applies the process color ink to positions shifted by one pixel in each of the positive main scanning direction and the positive sub-scanning direction from the positions to which the ink is applied in the third scan.

Here, since the auxiliary color ink is discharged from the two nozzle holes, the number of pixels to which the ink is applied should be eight in four scans. However, the ink discharged in the first and third scans are applied to same pixels, and ink discharged in the second and fourth scans are applied to same pixels. Therefore, the number of pixels to which the ink adheres are not eight.

In the fifth scan (Scan 5), the discharge head 211 applies the auxiliary color ink to positions shifted by one pixel in the positive sub-scanning direction from the positions to which the ink is applied in the fourth scan. Similarly, the discharge head 212 applies the process color ink to positions shifted by one pixel in the positive sub-scanning direction from the positions to which the ink is applied in the fourth scan.

Note that the sheet 11 is conveyed only in the negative sub-scanning direction. Accordingly, in the fifth scan, the ink is not applied to the pixels shifted one pixel in the negative sub-scanning direction from the pixels to which the ink is applied in the fourth scan. Therefore, to be exact, for example, in FIG. 7, the ink is not discharged at the upper right pixel of the eight pixels at which the auxiliary color ink is to be discharged, and the ink is discharged at a pixel 221 illustrated with broken lines. However, for the sake of easy recognition, in FIG. 7, the ink applied to the pixel 221 is given to the upper right pixel of the eight pixels. The same applies to the process color ink applied by the discharge head 212.

In the sixth scan (Scan 6), the discharge head 211 applies the auxiliary color ink to positions shifted by one pixel in each of the negative main scanning direction and the positive sub-scanning direction from the positions to which the ink is applied in the fifth scan. Similarly, the discharge head 212 applies the process color ink to positions shifted by one pixel in each of the negative main scanning direction and the positive sub-scanning direction from the positions to which the ink is applied in the fifth scan.

In six scans, the auxiliary color ink is applied to all of the eight pixels.

In the seventh scan (Scan 7), the discharge head 212 applies the process color ink to positions shifted by one pixel in each of the positive main scanning direction and the positive sub-scanning direction from the positions to which the ink is applied in the sixth scan.

In the eighth scan (Scan 8), the discharge head 212 applies the process color ink to the positions shifted by one pixel in each of the negative main scanning direction and the positive sub-scanning direction from the positions to which the ink is applied in the seventh scan.

In this manner, the discharge head 212 can form, with the process color ink, eight pixels in eight scans using one nozzle hole of, for example, the nozzle row 212*y*. Since the discharge head 213 operates in the same manner, 16 pixels can be formed with the process color ink in total in 8 scans, using one nozzle hole of the discharge head 212 and one nozzle hole of the discharge head 213.

If the discharge head 211 performs ink discharge in the manner similar to that performed by the discharge head 212 or 213, the auxiliary color ink would be applied to 8 pixels in 4 scans using, for example, one nozzle hole of the nozzle row 211*o*1 and one nozzle hole of the nozzle row 211*o*2. Then, the auxiliary color ink would be applied to 16 pixels in 8 scans, similar to process color ink. However, when the auxiliary color ink is discharged in the same discharge sequence as the process color ink, as described above, the positions of the pixels to which the ink adheres overlap between the first and third scans and also overlap between the second and fourth scans. Therefore, forming eight pixels the ink in four scans using two nozzle holes is not feasible.

Therefore, when the auxiliary color ink is discharged in the same number of scans as the process color ink discharge, the number of pixels at which the auxiliary color ink is discharged is different from the number of pixels of the process color, and there arise a pixel where ink is absent (a missing pixel). On the other hand, if the number of times of scan is increased (for example, the number of scans is increased from four times to six times) to prevent such missing pixels, the image forming time becomes long.

Here, an example of the ink discharge method according to the present embodiment will be described with reference to FIG. 8. In the example illustrated in FIG. 8, the head unit 2 illustrated in FIG. 4 discharges, by the multi-scan method, one of the process color inks and one auxiliary color ink at a plurality of pixels to form a given area on the sheet 11. However, differently from the comparative example described with reference to FIG. 7, in FIG. 8, the sequence of discharge of ink at the pixels for each scan is different between the process color ink and the auxiliary color ink.

Figure 8:
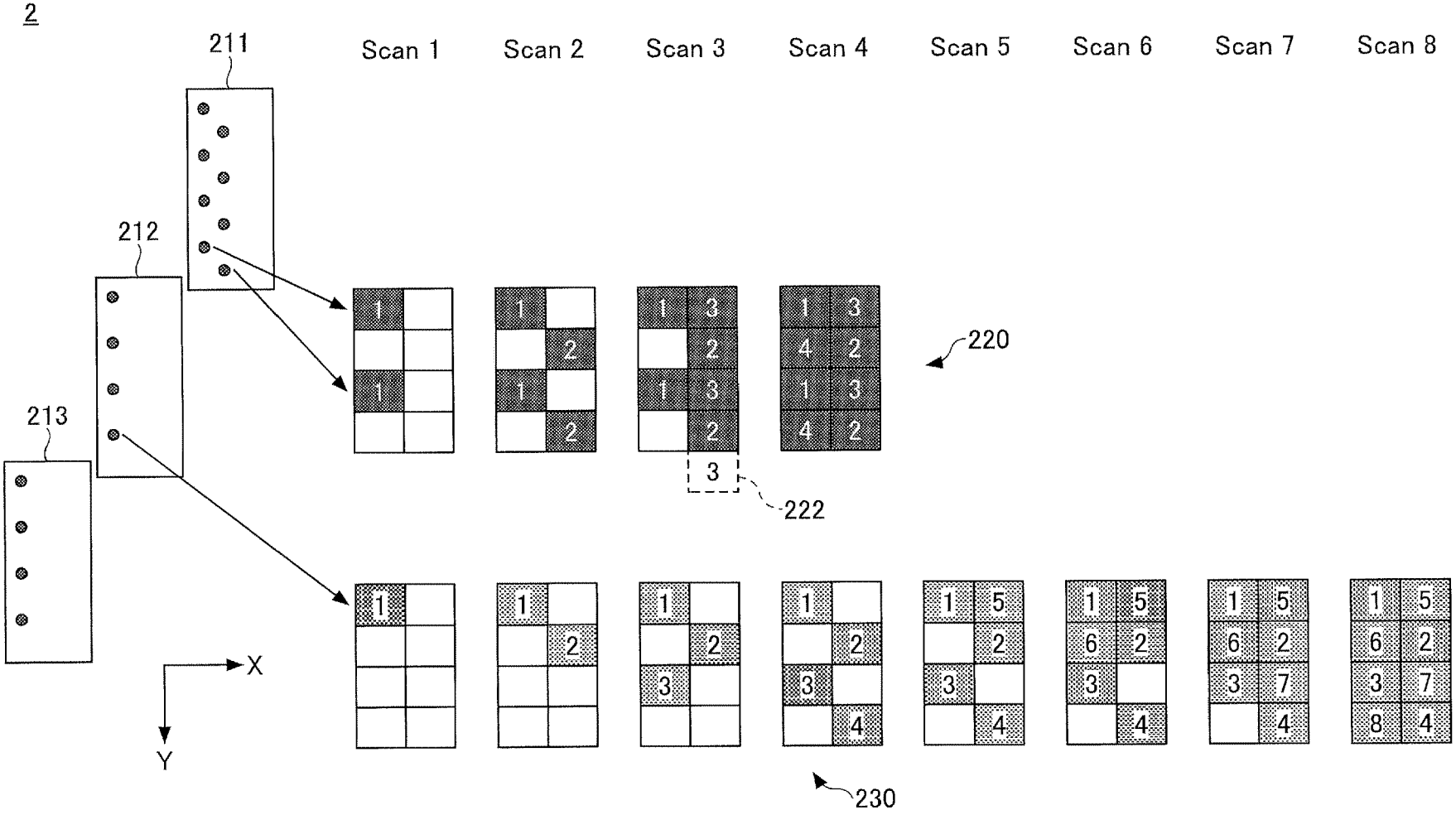
FIG. 8 is a diagram for explaining an example of multi-scan image formation according to Embodiment 1.

In FIG. 8, the number of nozzles in the discharge head, the squares representing the pixels, and the like are illustrated similar to those in FIG. 7, and thus redundant descriptions are omitted.

In FIG. 8, in the first scan (Scan 1), as illustrated in FIG. 8, the discharge head 211 discharges the auxiliary color ink at two pixels, and the discharge head 212 discharges the process color ink at one pixel.

In the second scan (Scan 2), the discharge head 211 applies the auxiliary color ink to positions shifted by one pixel in each of the positive main scanning direction and the positive sub-scanning direction from the positions to which the ink is applied in the first scan. Similarly, the discharge head 212 applies the process color ink to the positions shifted by one pixel in each of the positive main scanning direction and the positive sub-scanning direction from the positions to which the ink is applied in the first scan.

In the third scan (Scan 3), the discharge head 211 applies the auxiliary color ink to positions shifted by one pixel in the positive sub-scanning direction from the positions to which the ink is applied in the second scan. The discharge head 212 applies the process color ink to the positions shifted by one pixel in each of the negative main scanning direction and the positive sub-scanning direction from the positions to which the ink is applied in the second scan.

Note that the sheet 11 is conveyed only in the negative sub-scanning direction. Accordingly, in the third scan, the ink is not applied to the pixels shifted one pixel in the negative sub-scanning direction from the pixels to which the ink is applied in the second scan. Therefore, to be exact, for example, in FIG. 8, the ink is not discharged at the upper right pixel of the eight pixels at which the auxiliary color ink is to be discharged, and the ink is discharged at a pixel 222 illustrated with broken lines. However, for the sake of easy recognition, in FIG. 8, the ink applied to the pixel 222 is given to the upper right pixel of the eight pixels.

In the fourth scan (Scan 4), the discharge head 211 applies the auxiliary color ink to positions shifted by one pixel in each of the negative main scanning direction and the positive sub-scanning direction from the positions to which the ink is applied in the third scan. The discharge head 212 applies the process color ink to the positions shifted by one pixel in each of the positive main scanning direction and the positive sub-scanning direction from the positions to which the ink is applied in the third scan.

Here, unlike the example described with reference to FIG. 7, there is no overlap of pixels to which the auxiliary ink is applied in the respective scans, and the ink adheres to all of the eight pixels in four scans.

The sequence in which the discharge head 212 discharges the process color ink at the pixels after the fifth scan (Scan 5) is similar to that described with reference to FIG. 7, and thus redundant descriptions are omitted.

In this manner, the discharge head 212 can form, with the process color ink, eight pixels in eight scans using one nozzle hole of, for example, the nozzle row 212*y*. Since the discharge head 213 operates in the same manner, the process color ink can be discharged at 16 pixels in total in 8 scans using one nozzle hole of the discharge head 212 and one nozzle hole of the discharge head 213.

On the other hand, by changing the sequence of application of the auxiliary color ink from that of the process color ink, the auxiliary color ink can be discharged at eight pixels in four scans using, for example, one nozzle hole of the nozzle row 211*o*1 and one nozzle hole of the nozzle row 211*o*2. The auxiliary color ink can be discharged at 16 pixels in 8 scans. In this way, the auxiliary color ink can be discharged at the same number of pixels as the process color ink with the same number of scans as the process color ink. There is no need to increase the number of scans, and increases in image formation time and ink consumption can be avoided.

In FIG. 8, the pixel area 230 of the sheet 11 is an example of a "first area", and the sequence in which the discharge head 212 discharges the process color ink at a plurality of pixels that forms the pixel area 230 on the sheet 11 is an example of "first sequence". Further, in FIG. 8, the pixel area 220 is an example of the "second area", and the sequence in which the discharge head 211 discharges the auxiliary color ink at a plurality of pixels that forms the pixel area 220 on the sheet 11 is an example of "second sequence".

Figure 9:
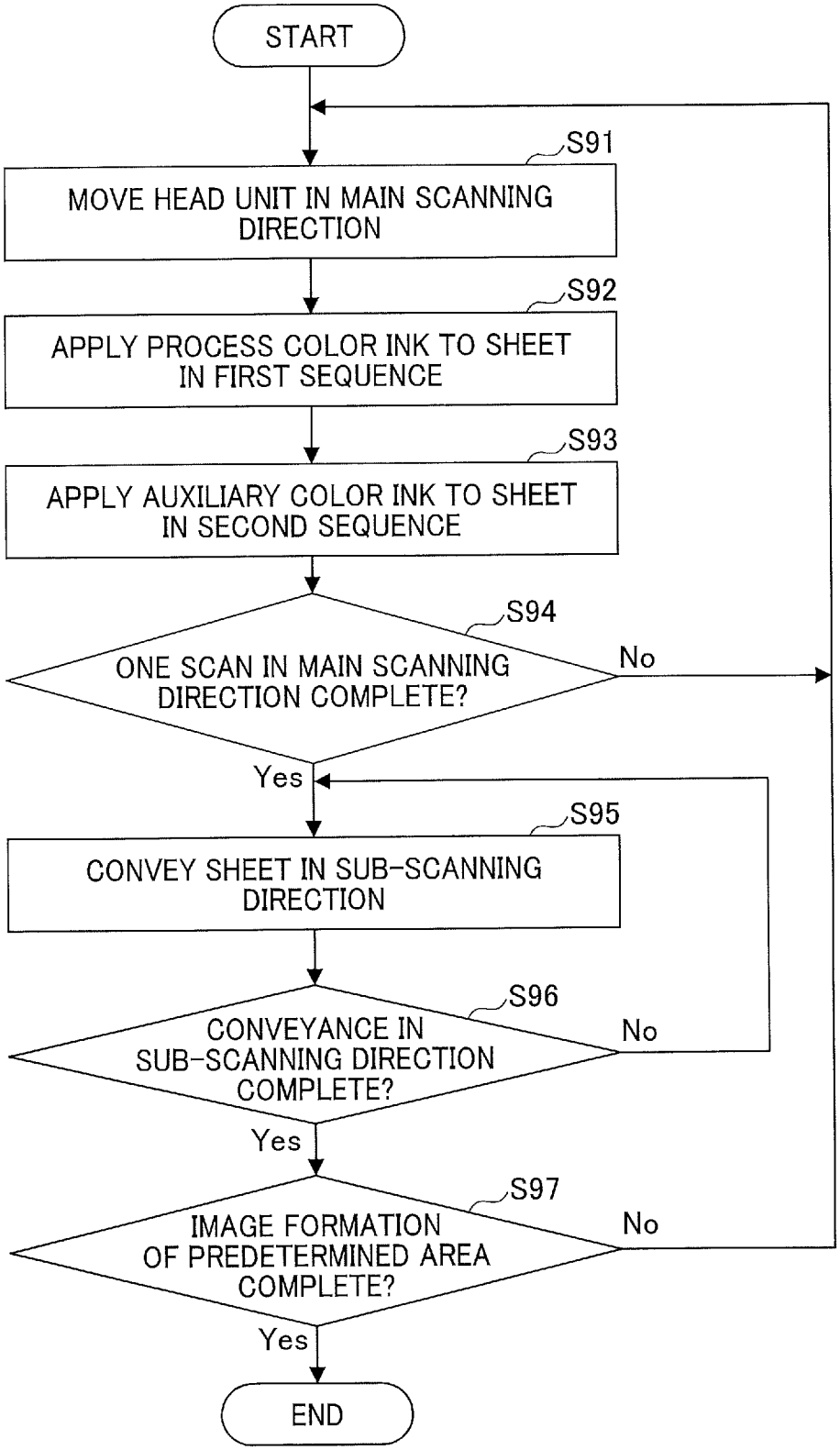
FIG. 9 is a flowchart illustrating an example of processing of a controller according to Embodiment 1.

FIG. 9 is a flowchart illustrating an example of processing by the controller 100 according to the present embodiment.

First, the carriage control unit 105 drives the main scanning motor 4 based on the output signal of the encoder sensor 9 to move the carriage 3 in the main scanning direction, thereby moving the head unit 2 in the main scanning direction (Step S91).

Next, while the head unit 2 moves, the process-color discharge control unit 106 drives the discharge heads 212 and 213 to discharge the process color ink at the plurality of pixels to form the first area on the sheet 11, according to the first sequence (Step S92).

While the head unit 2 moves, the auxiliary-color discharge control unit 107 drives the discharge head 211 to discharge the auxiliary color ink at the plurality of pixels to form the second area on the sheet 11, according to the second sequence (Step S93).

The system control unit 101 determines whether one scan in the main scanning direction has been completed (Step S94).

If one scan in the main scanning direction has not been completed (No in Step S94), the process returns to Step S91. When one scanning in the main scanning direction is completed (Yes in Step S94), the sheet conveyance control unit 108 drives the sub-scanning motor 121 to convey the sheet 11 in the sub-scanning direction, to a predetermined position in the sub-scanning direction (Step S95). The sheet conveyance control unit 108 can cause the carriage 3 to relatively scan the sheet 11 in the sub-scanning direction by conveying the sheet 11 in the sub-scanning direction.

The system control unit 101 determines whether one conveyance of the sheet 11 in the sub-scanning direction is completed (Step S96).

If one conveyance in the sub-scanning direction is not completed (No in Step S96), the process returns to step S95. If one conveyance in the sub-scanning direction is completed (Yes in step S96), the system control unit 101 determines whether the image formation of the predetermined area on the sheet 11 is completed (Step S97).

If the image formation of the predetermined area on the sheet 11 is not completed (No in Step S97), the process returns to Step S91. When the image formation of the predetermined area on the sheet 11 is completed (Yes in step S97), the controller 100 ends the process.

Thus, the image forming apparatus 1 can form an image on a predetermined area of the sheet 11 under the control of the controller 100.

The effects of the image forming apparatus (the liquid discharge apparatus) of the present embodiment will be described. In a liquid discharge apparatus using an auxiliary color ink, the auxiliary color ink is used less frequently than the process color ink. Accordingly, in some liquid discharge apparatuses, the number of discharge heads for the auxiliary color ink is reduced from the number of discharge heads for the process color ink.

For example, as described above, among a plurality of discharge heads having a predetermined number of nozzle rows, only one discharge head is used to discharge the auxiliary color ink, and the rest of the plurality of discharge heads are used to discharge the process color ink. In this case, for example, for discharge of one auxiliary color ink, two nozzle rows disposed side by side in the main scanning direction are provided in one discharge head. Further, for discharge of one process color ink, one nozzle row is provided in each of two discharge heads arranged in a shifted manner in the sub-scanning direction. Owing to such an arrangement of the nozzle rows, the number of nozzle holes for discharging one auxiliary color ink is equal to the number of nozzle holes for discharging one process color ink. Therefore, if appropriate, the process color ink and the auxiliary color ink can be discharged at the same number of pixels with a predetermined number of scans. However, in some cases, the difference in the arrangement of the nozzle rows hinders proper application of the auxiliary color ink to the predetermined area of the recording medium.

In the present embodiment, in the respective scans, a process color ink is discharged at a plurality of pixels that forms a first area on the sheet 11 in the first sequence, and an auxiliary color ink is discharged at a plurality of pixels that forms a second area on the sheet 11 in the second sequence. This method can prevent overlapping of the pixels to which the auxiliary color ink adheres in each scan. Accordingly, the number of pixels of image formation with the same number of scans can be identical between the process color and the auxiliary color.

The image formation with the auxiliary color can complete without increasing the number of times of scans, and increases in image formation time can be prevented. Then, in the multi-scan liquid discharge apparatus using the auxiliary color ink, the auxiliary color ink can be appropriately applied to a predetermined area of the recording medium.

Figure 10:
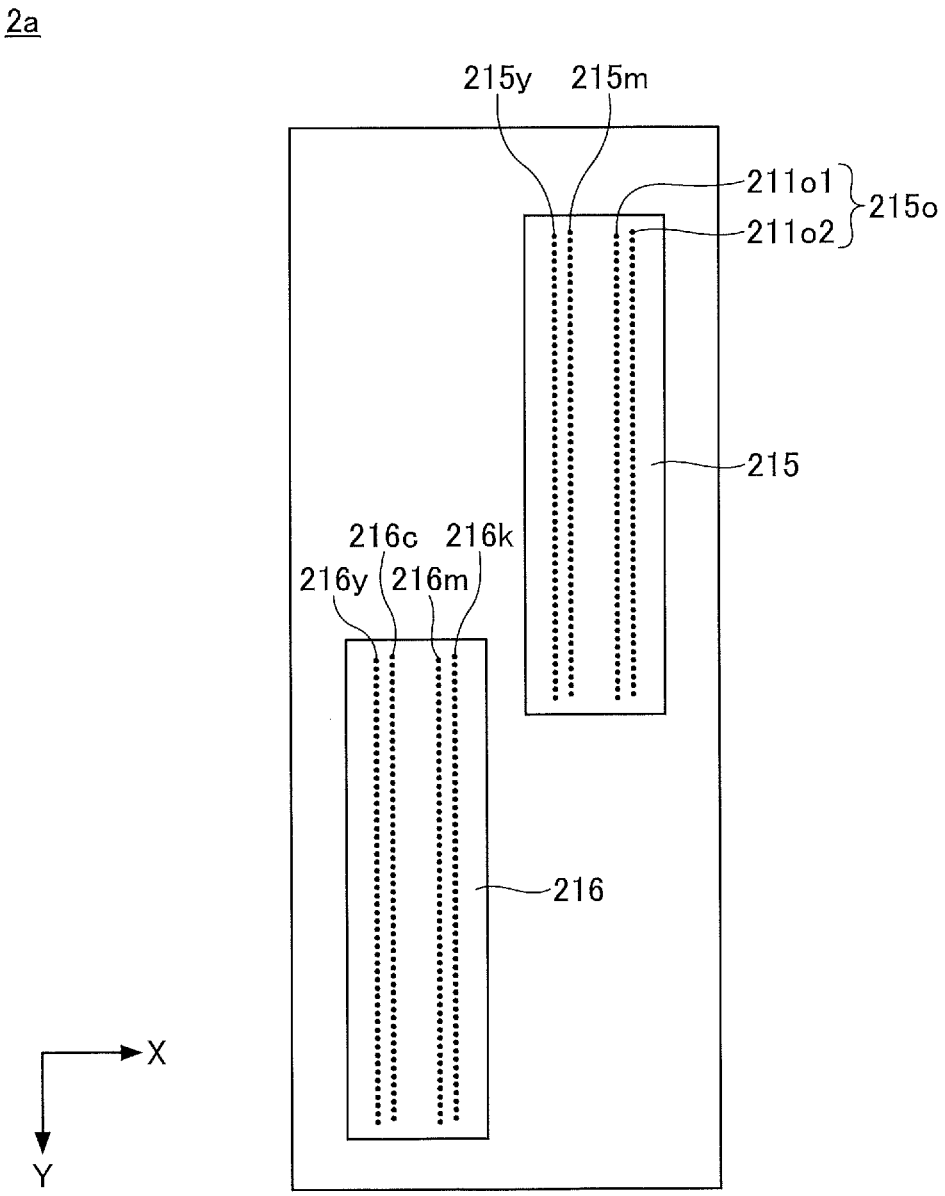
FIG. 10 is a view illustrating an example of a variation of the configuration of the head unit according to Embodiment 1.

Here, FIG. 10 is a view illustrating a variation of the configuration of the head unit according to the embodiment described above. FIG. 10 is a plan view of a head unit 2*a* as viewed in the ink discharge direction.

The head unit 2*a* includes a discharge head 215 and a discharge head 216. The discharge heads 215 and 216 each have the same configuration as the discharge head 211 described with reference to FIG. 3.

Of the two discharge heads 215 and 216 of the head unit 2*a*, the discharge head 215 is the upstream one (on the negative side) in the main scanning direction and the downstream one (on the positive side) in the sub-scanning direction. The discharge head 215 includes a nozzle row group 215*o*, a nozzle row 215*y*, and a nozzle row 215*m*. The nozzle row group 215*o* includes a nozzle row 215*o*1 and a nozzle row 215*o*2.

The nozzle row 215*y* discharges yellow ink, which is one of the process colors, from 64 nozzle holes lined in the sub-scanning direction. The nozzle row 215*m* is disposed at a position apart from the nozzle row 215*y* in the positive main scanning direction. The nozzle row 215*m* discharges magenta ink, which is one of the process colors, from the 64 nozzle holes lined in the sub-scanning direction.

The nozzle row 215*o*1 is disposed at a position apart from the nozzle row 215*m* in the positive main scanning direction. The nozzle row 215*o*1 discharges orange ink, which is one of the auxiliary colors, from 64 nozzle holes lined in the sub-scanning direction. The nozzle row 215*o*2 is disposed at a position apart from the nozzle row 215*o*1 in the positive main scanning direction, and discharges the orange ink from 64 nozzle holes lined in the sub-scanning direction.

The discharge head 216 is disposed at a position deviated from the discharge head 215 in the negative main scanning direction and in the positive sub-scanning direction in the head unit 2. The discharge head 216 includes a nozzle row 216*y*, a nozzle row 216*c*, a nozzle row 216*m*, and a nozzle row 216*k*.

The nozzle row 216*y* discharges ink of yellow, which is one of the process colors, from 64 nozzle holes lined in the sub-scanning direction. The nozzle row 216*c* is disposed at a position apart from the nozzle row 216*y* in the positive main scanning direction, and discharges ink of cyan, which is one of the process colors, from the nozzle holes lined in the sub-scanning direction.

The nozzle row 216*m* is disposed at a position apart from the nozzle row 216*c* in the positive main scanning direction. The nozzle row 216*m* discharges ink of magenta, which is one of the process colors, from the 64 nozzle holes lined in the sub-scanning direction. The nozzle row 216*k* is disposed at a position apart from the nozzle row 216*m* in the positive main scanning direction. The nozzle row 216*k* discharges ink of black, which is one of the process colors, from the nozzle holes lined in the sub-scanning direction.

The nozzle row group 215*o* of the discharge head 215 is an example of the "second nozzle row group". Further, a nozzle row group including the nozzle row 215*y* of the discharge head 215 and the nozzle row 216*y* of the discharge head 216 is an example of the "first nozzle row group". Further, a nozzle row group including the nozzle row 215*m* and the nozzle row 216*m* is an example of the "first nozzle row group".

As illustrated in FIG. 4, the discharge head 212 is disposed at a position shifted from the discharge head 211 in the sub-scanning direction, and the discharge head 213 is disposed at a position shifted from the discharge head 212 in the sub-scanning direction. By arranging in this manner, the range in which the ink is applied to the sheet 11 can be expanded in the sub-scanning direction by one scan in the main scanning direction of the head unit 2.

The relative positions between the discharge heads 215 and 216 are similar to those of the discharge heads 211 to 213 in the head unit 2, and thus the description thereof is omitted.

The image forming apparatus 1 according to the present variation discharges, with the discharge head 215, the auxiliary color ink onto the sheet 11 in the method described with reference to FIG. 8 and discharges, with the discharge heads 215 and 216, the process color inks onto the sheet 11 in the method described with reference to FIG. 8, thereby, attaining the same effect as in the configuration using the head unit 2 illustrated in FIG. 4.

Embodiment 2

Next, a liquid discharge apparatus according to Embodiment 2 will be described. Note that descriptions of elements identical or similar to those of the above-described embodiment are omitted to avoid redundancy.

In Embodiment 1, at a plurality of pixels to form a predetermined area on the sheet 11, the process color ink is discharged in the first sequence, and the auxiliary color ink is discharged in a second sequence, in accordance with the respective scans. Specifically, for example, in the third scan, the process-color discharge control unit 106 causes the head unit 2 to discharge the process color ink at the pixels shifted by one pixel in each of the negative main scanning direction and the positive sub-scanning direction from the positions to which the ink is applied in the second scan. On the other hand, in the third scan, the auxiliary-color discharge control unit 107 causes the head unit 2 to discharge the auxiliary color ink at pixels shifted by one pixel in the positive sub-scanning direction from the positions to which the ink is applied in the second scan.

A controller 100*a* according to the present embodiment is configured to be able to change the second sequence of applying the auxiliary color ink. For example, the controller 100*a* enables the auxiliary-color discharge control unit 107 to discharge, in the third scan, the auxiliary color ink to a position changed from the position one pixel shifted in the positive sub-scanning direction from the position at which the auxiliary color ink is discharged in the second scan.

Figure 11A:
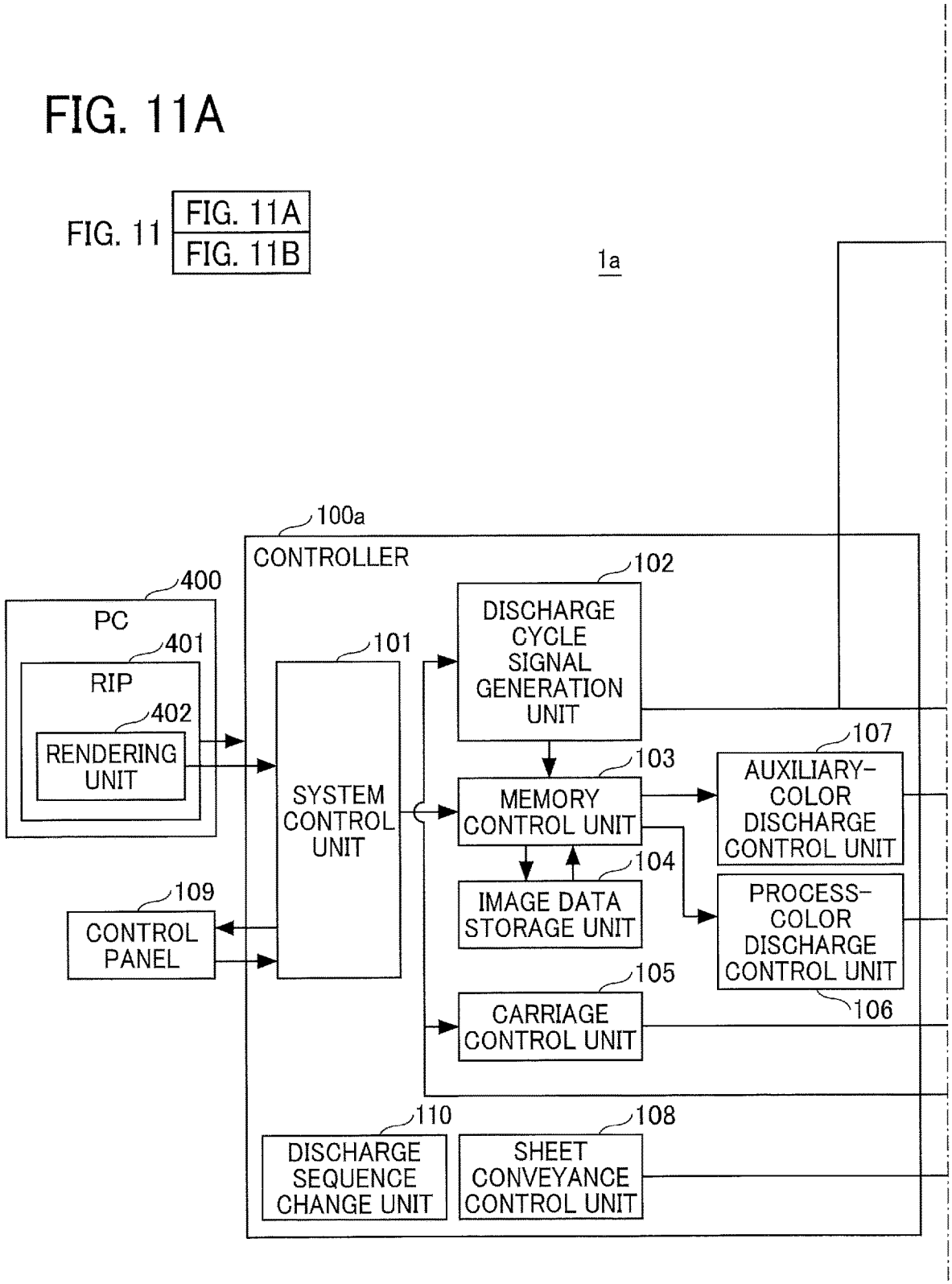
FIGS. 11A and 11B (FIG. 11) are block diagrams illustrating functional components of a controller according to Embodiment 2.
Figure 11B:
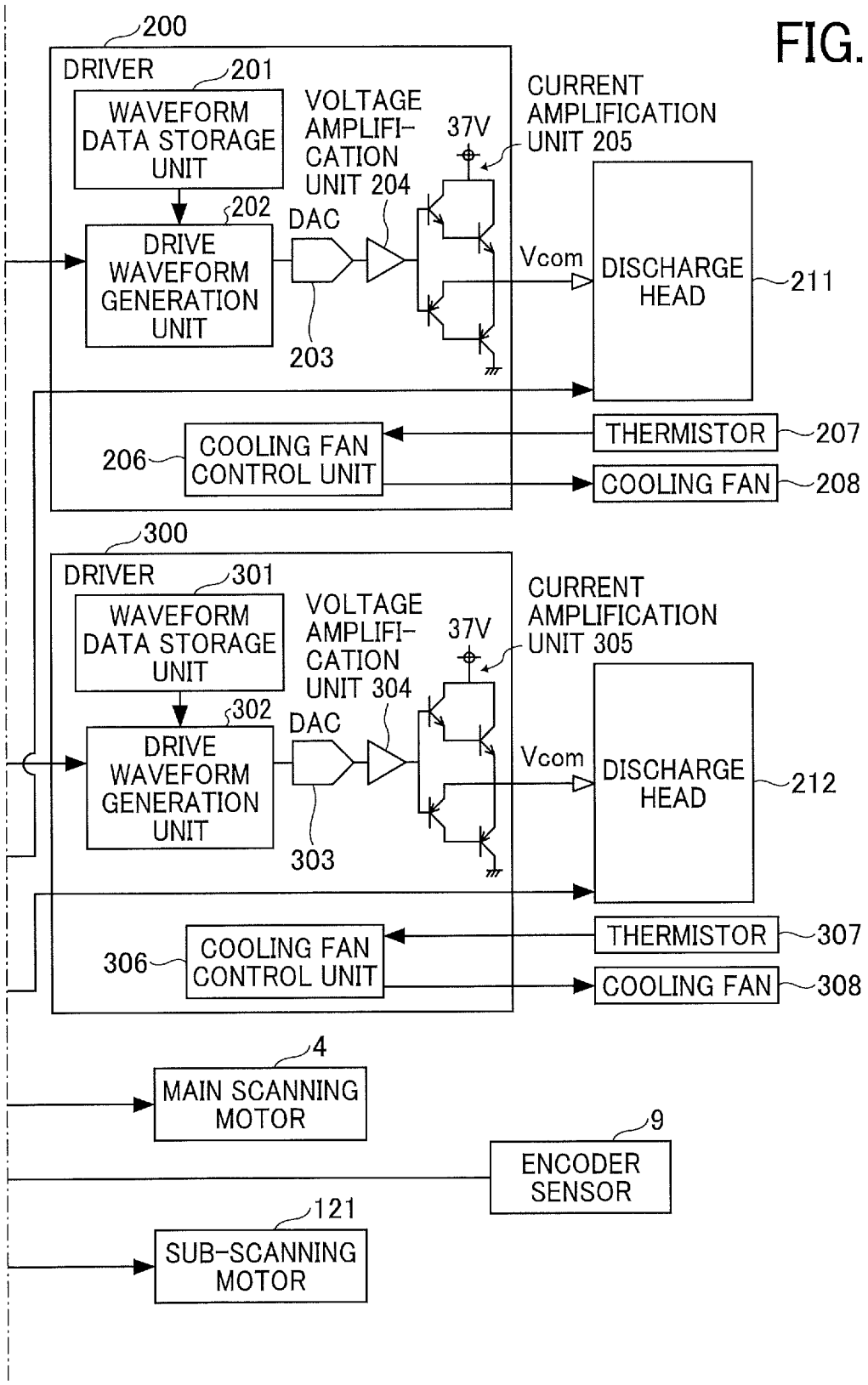

FIG. 11 is a block diagram illustrating functional components of the controller 100*a* according to the present embodiment. The controller 100*a* includes a discharge sequence change unit 110. The discharge sequence change unit 110 changes the sequence of auxiliary color ink discharge, set by the auxiliary-color discharge control unit 107, at the plurality of pixels that forms the predetermined area on the sheet 11, for each scan (an example of the second sequence).

For example, there are cases where the arrangement of the nozzle row for discharging the auxiliary color ink and the nozzle row for discharging the process color ink is changed in the head unit 2. Depending on the arrangement of the nozzle rows, the proper sequence of applying the auxiliary color ink onto the sheet 11 may change.

In the present embodiment, with the discharge sequence change unit 110, the sequence of the auxiliary color ink discharge onto the sheet 11 can be made appropriate in accordance with the arrangement of the nozzle row to discharge the auxiliary color ink and the nozzle row to discharge the process color ink.

The effects of the second embodiment other than the effect described-above are similar to the effects described in Embodiment 1.

The liquid discharge apparatuses according to the embodiments and the variation described above are illustrative and do not limit the present invention. Thus, numerous additional modifications and variations are possible in light of the above teachings. For example, elements and/or features of different illustrative embodiments may be combined with each other and/or substituted for each other within the scope of the present invention.

The above-described embodiments and the variation concern the examples of the auxiliary color ink being the second color. However, depending on the frequency of use, it is possible that application of the process color ink to a predetermined area of the recording medium becomes improper as described above. The above-described embodiments and variation are also applicable to such a case, to properly apply the process color ink onto the predetermined area of the recording medium.

The embodiments of the present disclosure also include a liquid discharge method and a program. For example, an embodiment of the present disclosure provides a liquid discharge method by a liquid discharge apparatus having a plurality of nozzle rows each of which includes a plurality of nozzle holes for discharging liquid lined in a sub-scanning direction intersecting a main scanning direction. The liquid discharge apparatus is configured to discharge the liquid onto a recording medium. Specifically, the plurality of nozzle rows includes a first nozzle row group configured to discharge a first color liquid for image formation and a second nozzle row group configured to discharge a second color liquid different in color from the first color liquid. The first nozzle row group includes at least two nozzle rows disposed at positions shifted from each other in the sub-scanning direction, and the second nozzle row group includes at least two nozzle rows arranged in the main scanning direction. The method includes: causing the first nozzle row group and the second nozzle row group to scan the recording medium in the main scanning direction a plurality of times; causing the first nozzle row group and the second nozzle row group to scan the recording medium in the sub-scanning direction a plurality of times; discharging, with the first nozzle row group, the first color liquid corresponding to a plurality of pixels to form a first area of the recording medium, in accordance with the scanning in the main scanning direction and the sub-scanning direction in a first sequence; and discharging, with the second nozzle row group, the second color liquid corresponding to a plurality of pixels to form a second area of the recording medium, in accordance with the scanning in the main scanning direction and the sub-scanning direction in a second sequence different from the first sequence.

Further, an embodiment of the present disclosure provides a program executed in the liquid discharge apparatus having a plurality of nozzle rows each of which includes a plurality of nozzle holes for discharging liquid lined in the sub-scanning direction intersecting the main scanning direction. The liquid discharge apparatus is configured to discharge the liquid onto a recording medium. The plurality of nozzle rows includes a first nozzle row group configured to discharge a first color liquid for image formation and a second nozzle row group configured to discharge a second color liquid different in color from the first color liquid. The first nozzle row group includes at least two nozzle rows disposed at positions shifted from each other in the sub-scanning direction, and the second nozzle row group includes at least two nozzle rows arranged in the main scanning direction. When executed by one or more processors, the program causes the processors to perform: processing to cause the first nozzle row group and the second nozzle row group to scan the recording medium in the main scanning direction a plurality of times; processing to cause the first nozzle row group and the second nozzle row group to scan the recording medium in the sub-scanning direction a plurality of times; processing to discharge, with the first nozzle row group, the first color liquid corresponding to a plurality of pixels to form a first area of the recording medium, in accordance with the scanning in the main scanning direction and the sub-scanning direction in a first sequence; and processing to discharge, with the second nozzle row group, the second color liquid corresponding to a plurality of pixels to form a second area of the recording medium, in accordance with the scanning in the main scanning direction and the sub-scanning direction in a second sequence different from the first sequence.

According to such a liquid discharge method and program, the effects similar to those of the above-described liquid discharge apparatuses can be obtained.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A liquid discharge apparatus configured to discharge liquid onto a recording medium, the liquid discharge apparatus comprising:

a plurality of nozzle rows in each of which a plurality of nozzle holes to discharge liquid is lined in a sub-scanning direction intersecting a main scanning direction, the plurality of nozzle rows including:

a first nozzle row group including at least two nozzle rows disposed at positions shifted from each other in the sub-scanning direction and configured to discharge a first color liquid; and a second nozzle row group including at least two nozzle rows arranged in the main scanning direction and configured to discharge a second color liquid different in color from the first color liquid;

a main scanning device configured to cause the first nozzle row group and the second nozzle row group to scan the recording medium a plurality of times in the main scanning direction;

a sub-scanning device configured to cause the first nozzle row group and the second nozzle row group to scan the recording medium a plurality of times in the sub-scanning direction; and circuitry configured to:

cause the first nozzle row group to discharge the first color liquid to positions corresponding to a plurality of pixels to form a first area on the recording medium, in accordance with scanning in the main scanning direction and the sub-scanning direction in a first sequence; and cause the second nozzle row group to discharge the second color liquid to positions corresponding to a plurality of pixels to form a second area on the recording medium, in accordance with scanning in the main scanning direction and the sub-scanning direction in a second sequence different from the first sequence, wherein the first nozzle row group and the second nozzle row group are disposed at different positions in the sub-scanning direction, and the circuitry is further configured to control the first nozzle row group and the second nozzle row group to scan a same number of times for a same number of pixels.

2. The liquid discharge apparatus according to claim 1, wherein the first nozzle row group includes:

a nozzle row disposed at a position different from the second nozzle row group in the sub-scanning direction; and a nozzle row disposed at an identical position to a position of the second nozzle row group in the sub-scanning direction.

3. The liquid discharge apparatus according to claim 1, wherein the sub-scanning device is configured to convey the recording medium in the sub-scanning direction, to cause the first nozzle row group and the second nozzle row group to scan the recording medium in the sub-scanning direction a plurality of times.

4. The liquid discharge apparatus according to claim 1, wherein the first nozzle row group is configured to discharge at least one of a yellow liquid, a magenta liquid, a cyan liquid, and a black liquid, and wherein the second nozzle row group includes a nozzle row configured to discharge a liquid of a color other than yellow, magenta, cyan, and black.

5. The liquid discharge apparatus according to claim 1, wherein, regarding the first area, the circuitry is configured to:

cause the first nozzle row group to apply, in a second scan in the main scanning direction, the first color liquid to a position on the recording medium shifted by one pixel to a positive side in the main scanning direction and by one pixel to a positive side in the sub-scanning direction from a position on the recording medium to which the first color liquid is applied in a first scan in the main scanning direction;

cause the first nozzle row group to apply, in a third scan in the main scanning direction, the first color liquid to a position on the recording medium shifted by one pixel to a negative side in the main scanning direction and by one pixel in the positive side in the sub-scanning direction from the position to which the first color liquid is applied in the second scan;

cause the first nozzle row group to apply, in a fourth scan in the main scanning direction, the first color liquid to a position on the recording medium shifted by one pixel to the positive side in the main scanning direction and by one pixel in the positive side in the sub-scanning direction from the position to which the first color liquid is applied in the third scan, and wherein, regarding the second area, the circuitry is configured to:

cause the second nozzle row group to apply, in the second scan, the second color liquid to a position on the recording medium shifted by one pixel to the positive side in the main scanning direction and by one pixel in the positive side in the sub-scanning direction from a position on the recording medium to which the second color liquid is applied in the first scan;

cause the second nozzle row group to apply, in the third scan, the second color liquid to a position on the recording medium shifted by one pixel to the positive side in the sub-scanning direction from the position to which the second color liquid is applied in the second scan; and cause the second nozzle row group to apply, in the fourth scan, the second color liquid to a position on the recording medium shifted by one pixel to the negative side in the main scanning direction and by one pixel in the positive side in the sub-scanning direction from the position to which the second color liquid is applied in the third scan.

6. The liquid discharge apparatus according to claim 1, wherein the circuitry is configured to:

accept input image data;

decompose the input image data into a plurality of rendering data generated for each scan by the main scanning device and the sub-scanning device; and causes the plurality of nozzle rows to perform image formation based on the plurality of rendering data.

7. The liquid discharge apparatus according to claim 1, wherein the circuitry is configured to change the second sequence.

8. The liquid discharge apparatus according to claim 1, wherein the second nozzle row group is disposed at a most upstream side in the sub-scanning direction among the plurality of nozzle rows.

* * * * *